US009890524B1

(12) United States Patent
Law et al.

(10) Patent No.: US 9,890,524 B1
(45) Date of Patent: Feb. 13, 2018

(54) PLUNGER DEVICE

(71) Applicants: Karen Law, Lynnwood, WA (US); Chris Corrigan, Seattle, WA (US)

(72) Inventors: Karen Law, Lynnwood, WA (US); Chris Corrigan, Seattle, WA (US)

(73) Assignee: REVELATIONIST, LLC, Lynnwod, WA (US)

( * ) Notice: Subject to any disclaimer, the term of this patent is extended or adjusted under 35 U.S.C. 154(b) by 0 days.

(21) Appl. No.: 15/424,624

(22) Filed: Feb. 3, 2017

Related U.S. Application Data

(60) Provisional application No. 62/397,807, filed on Sep. 21, 2016, provisional application No. 62/423,989, filed on Nov. 18, 2016.

(51) Int. Cl.
*E03D 11/00* (2006.01)
*E03C 1/308* (2006.01)
*A47K 17/00* (2006.01)

(52) U.S. Cl.
CPC ..... *E03C 1/308* (2013.01); *A47K 17/00* (2013.01)

(58) Field of Classification Search
USPC ..... 4/255.11
See application file for complete search history.

(56) References Cited

U.S. PATENT DOCUMENTS 4,768,237 A 9/1988 Torti
5,099,527 A * 3/1992 Roose ..... E03C 1/308 294/131
7,328,793 B2 * 2/2008 Leaphart, Jr. ..... A47K 17/00 206/15.2
7,523,510 B1 * 4/2009 Biagi ..... E03C 1/308 221/63

OTHER PUBLICATIONS

"http://en.wikipedia.org/w/index.php?title=Door_chain &oldid=718680565" Wikipedia.May 4, 2016.
"https://www.grainger.com/product/CARE-WIPES-Hand-Sanitizing-Wipes-6MGG6" Care Wipes. Hand Sanitizing Wipes, 7×8", 70 Wipes per Container, 1 EA.
"http://www.halfbakery.com/idea/Plunger_20Protectors" Half Bakery. Plunger Protectors—Never Clean Your Plunger Again.
"http://www.homedepot.com/p/Korky-Beehive-Max-Toilet-Plunger-99-8A/203765220" Home Depot. Korky Beehive Max Toilet Plunger.
"https://www.pinterest.com/pin/399483429421230132/" Pinterest. Markos Markowsky, magedesign.com.
"https://www.pinterest.com/pin/399483429421230132/" Pinterest. Retro to Go. 1970's Aloys Gangkofer-designed Erco space age table lamp.
Vocus PRW Holdings, LLC. Chrissa Chverchko, InventHelp Inventor Designs Better Toilet-Plunger Storage (ALL-534). pp. 1-3. Oct. 18, 2015. Pittsburgh, PA.

* cited by examiner

*Primary Examiner* — Lauren Crane
(74) *Attorney, Agent, or Firm* — Ruttler Mills, PLLC; James J. Ruttler

(57) ABSTRACT

A plunger device includes, but is not limited to, a shaft; a plunger suction cup coupled to the shaft, which plunger suction cup flares from the shaft to a perimeter edge to define a concavity; and a receptacle centrally positioned within the concavity on an underside of the plunger suction cup for removably retaining one or more disposable plunger bags.

19 Claims, 7 Drawing Sheets

112
114
100
102
104

PLUNGER DEVICE

PRIORITY CLAIM

This application claims the benefit of and/or is a non-provisional of U.S. Provisional Patent Application 62/397,807 filed Sep. 21, 2016 and U.S. Provisional Patent Application 62/423,989 filed Nov. 18, 2016. The foregoing applications are incorporated by reference in their entirety as if fully set forth herein.

FIELD OF THE INVENTION

This invention relates generally to consumer product and, more specifically, to a plunger device.

SUMMARY

In one embodiment, a plunger device includes, but is not limited to, a shaft; a plunger suction cup coupled to the shaft, which plunger suction cup flares from the shaft to a perimeter edge to define a concavity; and a receptacle centrally positioned within the concavity on an underside of the plunger suction cup for removably retaining one or more disposable plunger bags.

In another embodiment, a plunger device includes, but is not limited to a shaft; a handle extending at least partially horizontally from the shaft; and a plunger suction cup coupled to the shaft, which plunger suction cup flares from the shaft to a perimeter edge to define a concavity.

In a further embodiment, a plunger device includes, but is not limited to, a shaft including a hollow chamber for storing one or more disposable plunger bags; a handle that extends at least partially horizontally from the shaft; a plunger suction cup coupled to the shaft, which plunger suction cup flares from the shaft to a perimeter edge to define a concavity; a receptacle centrally positioned within the concavity on an underside of the plunger suction cup for removably retaining one or more disposable plunger bags; a removable cap that includes a perimeter flange with open bottom that accommodates the handle therewithin and that includes a solid top that provides a table surface for supporting objects when the plunger device is between uses; and a base receptacle that covers the plunger suction cup when the plunger device is between uses.

BRIEF DESCRIPTION OF THE DRAWINGS

Embodiments of the present invention are described in detail below with reference to the following drawings.

DETAILED DESCRIPTION

This invention relates generally to a consumer product and, more specifically, to a plunger device. Specific details of certain embodiments of the invention are set forth in the following description and in FIGS. 1-7 to provide a thorough understanding of such embodiments. The present invention may have additional embodiments, may be practiced without one or more of the details described for any particular described embodiment, or may have any detail described for one particular embodiment practiced with any other detail described for another embodiment.

Figure 1:
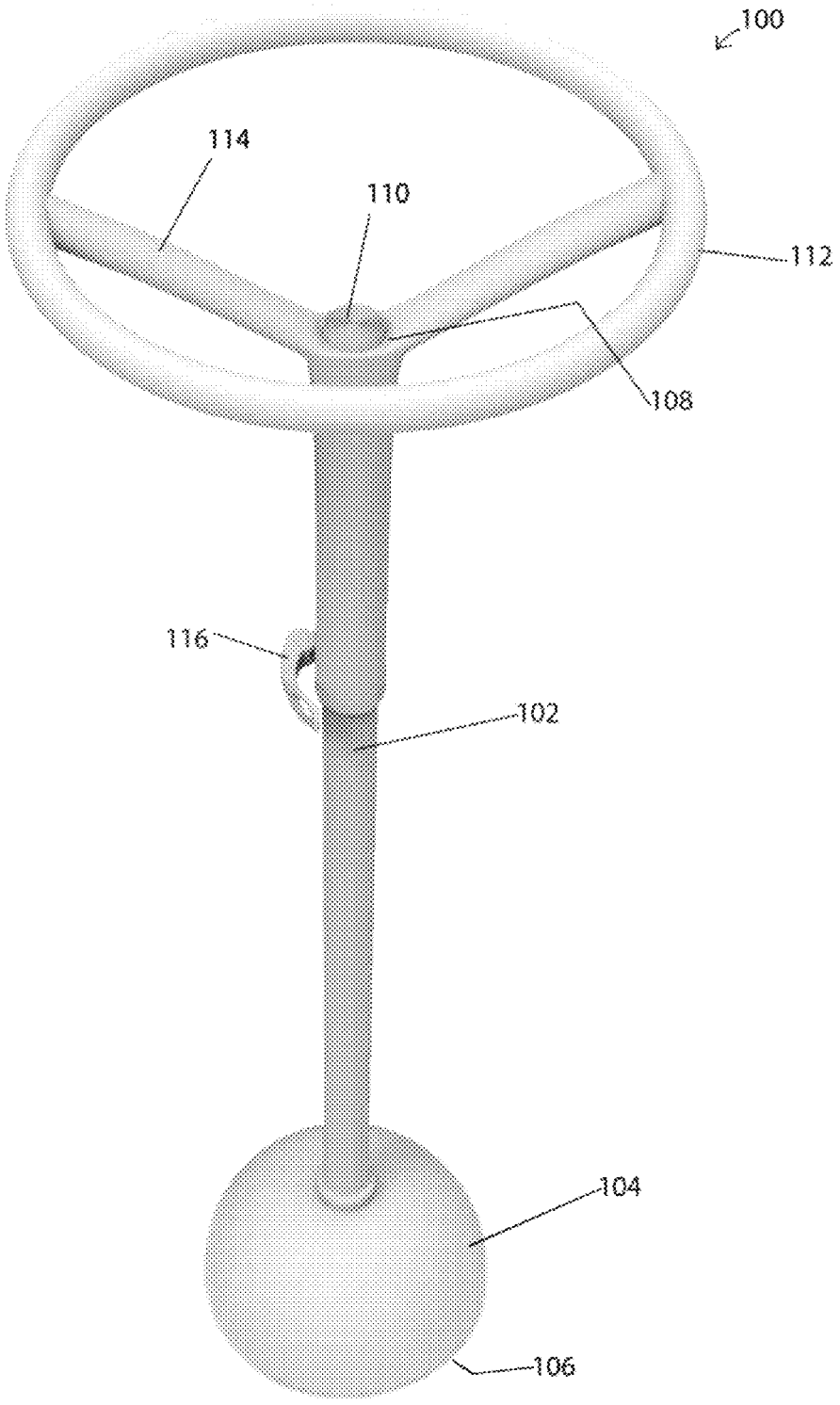
FIG. 1 is a top perspective view of a plunger device, in accordance with an embodiment of the invention.

FIG. 1 is a top perspective view of a plunger device, in accordance with an embodiment of the invention.

In one embodiment, a plunger device 100 includes, but is not limited to, a shaft 102; a plunger suction cup 104 coupled to the shaft 102, which plunger suction cup 104 flares from the shaft 102 to a perimeter edge 106 to define a concavity; and a receptacle centrally positioned within the concavity on an underside of the plunger suction cup 104 for removably retaining one or more disposable plunger bags.

In another embodiment, a plunger device 100 includes, but is not limited to, a shaft 102; a handle 112 extending at least partially horizontally from the shaft 102; and a plunger suction cup 104 coupled to the shaft 102, which plunger suction cup 104 flares from the shaft 102 to a perimeter edge 106 to define a concavity.

In one embodiment, the shaft 102 includes, but is not limited to an elongated member 102 that extends from the plunger suction cup 104; and a hollow chamber 108 disposed within the elongated member 102 for storing one or more disposable plunger bags 110. In certain embodiments, the hollow chamber 108 is disposed within the elongated member 102 at an end of the elongated member 102 opposite the plunger suction cup 104.

In one embodiment, a handle 112 extends at least partially horizontally from the shaft 102. In certain embodiments, the handle includes, but is not limited to, a circular member 112 having one or more radial arms 114 that extend at least partially horizontally from the shaft 102, the circular member 112 circumscribing the shaft 102 about a substantially constant radius. In one particular embodiment, the circular member 112 comprises two radial arms 114 that extend upwardly and outwardly from an end of the shaft 102.

In one embodiment, one or more disposable biodegradable and flushable plunger bags 110 are provided and stowable/retrievable from the hollow chamber 108.

The plunger device 100 can be variously sized and shaped. For example, the plunger device can be approximately 2-5 feet tall. The shaft 102 can be approximately 1 inch to 3 inches in diameter. The handle 112 can be approximately 6 inches to 12 inches in radius and ½ to 3 inches in diameter. The suction cup 104 can be approximately 2 inches to 6 inches in radius. The plunger device 100 can be constructed of various materials including plastic, fiberglass, leather, cloth or fabric, rubber, carbon fiber, metal, wood, ceramic, or any other synthetic or natural material.

The handle 112 can be removable as shown from the shaft 102 or can be part of a unitary structure as further discussed and illustrated herein. The handle 112 can include one, two, three, or more radial arms 114 for structural integrity and/or design appeal. Additionally, different handles 112 are contemplated including a horizontal bar, a butterfly grip, and many others that are shown and illustrated in the provisional patent applications incorporated by reference herein. In instances where the handle 112 is removably attached to the shaft 102, a clasp 116 can be provided to secure the handle 112 to the shaft 102. However, other means of securing the handle 112 to the shaft 102 are possible including a friction lock, threads, a locking screw, a locking pin, or a snap fit.

The biodegradable bags 110 are sized and shaped to fit over the suction cup 104 during usage of the plunger device 100 while clearing toilet or pipe clogs. The biodegradable bags 110 are shown rolled up and stowed within the hollow chamber 108, but it is also possible to fold or stuff the biodegradable bags 110 within the hollow chamber 108. Additionally, the biodegradable bags 110 may be non-biodegradable or compostable. In certain embodiments, the biodegradable bags 110 have a shape, volume, and curvature that conforms to the suction cup. However, the biodegradable bags 110 may also be standard square or rectangular bags similar to those use for pet waste.

The hollow chamber 108 can be differently sized or shaped, such as cubical, rectangular, oval, or other regular or irregular shape. Furthermore, the hollow chamber 108 can be positioned differently such as within the radial arm 114, the circular handle 112, or the shaft 102.

The shaft 102 can be cylindrical as depicted or another shape, such as rectangular, square, triangular, curvilinear, or other regular or irregular shape. The shaft 102 can be adjustable in length or fixed. Furthermore, the shaft 102 may include an articulating joint to permit movement.

The suction cup 104 can be removable or fixed to the shaft 102. Typical suction cups can be used for the suction cup 104 or the suction cup 104 can be customized for a particular purpose. As is illustrated and discussed further herein, the suction cup 104 can include an attachment point on its underside for securing a disposable bag 110 thereon.

Therefore, the plunger device 100 provides a convenient and ergonomical handle that maximizes leverage during usage of the plunger device 100 to clear or unclog a toilet, drain, or other pipe or conduit. The disposable bags 110 are storable between uses and, when needed, are removable to protect the suction cup 104 during usage.

Figure 2:
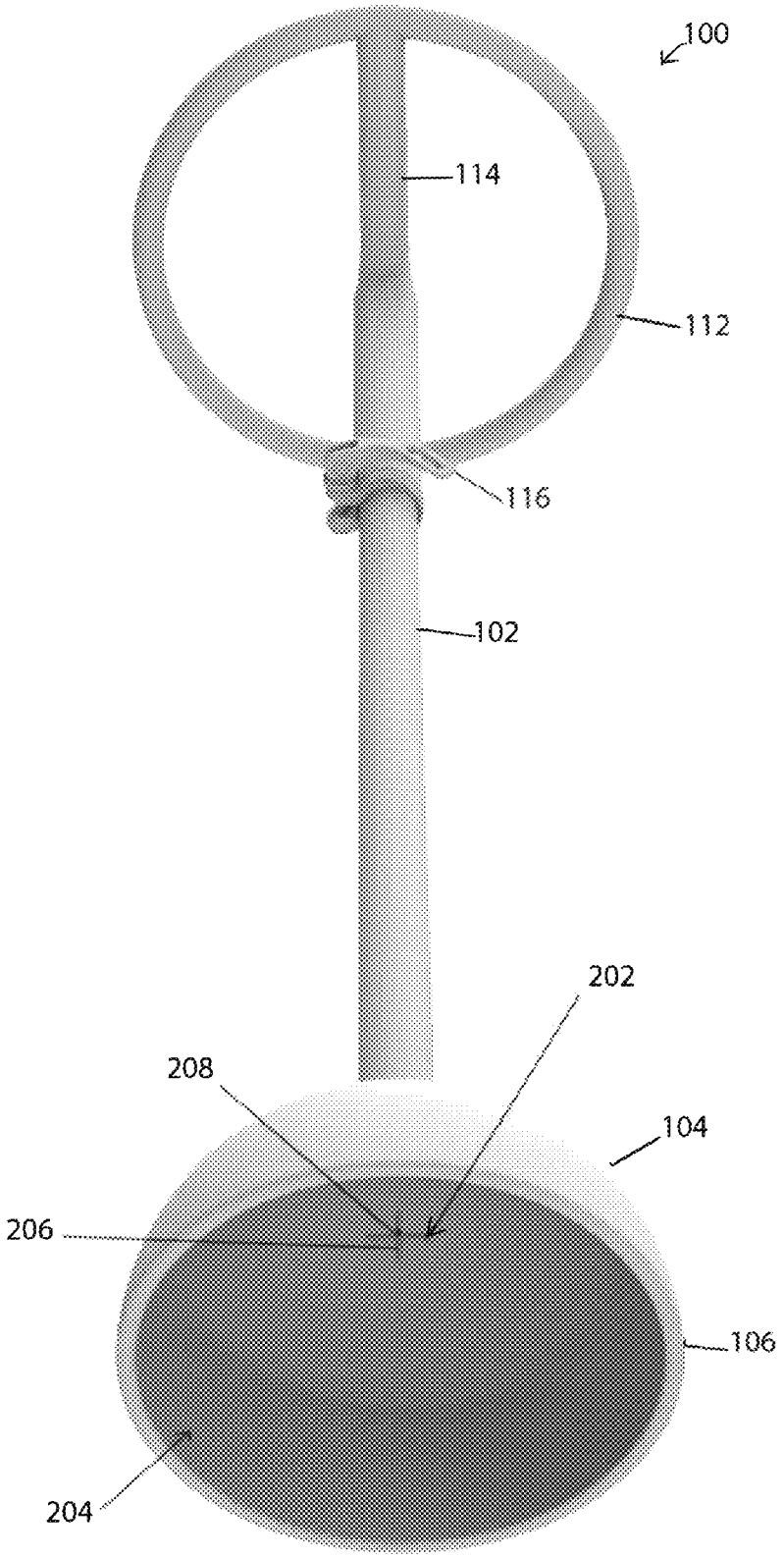
FIG. 2 is a bottom perspective view of a plunger device, in accordance with an embodiment of the invention.

FIG. 2 is a bottom perspective view of a plunger device, in accordance with an embodiment of the invention.

In one embodiment, a plunger device 100 includes, but is not limited to, a shaft 102; a plunger suction cup 104 coupled to the shaft 102, which plunger suction cup 104 flares from the shaft 102 to a perimeter edge to define a concavity 204; and a receptacle 202 centrally positioned within the concavity 204 on an underside of the plunger suction cup 104 for removably retaining one or more disposable plunger bags 110.

In another embodiment, a plunger device 100 includes, but is not limited to, a shaft 102; a handle 112 extending at least partially horizontally from the shaft 102; and a plunger suction cup 104 coupled to the shaft 102, which plunger suction cup 104 flares from the shaft 102 to a perimeter edge 106 to define a concavity 204.

In certain embodiments, the receptacle 202 includes, but is not limited to, a hollow chamber in line with a longitudinal axis of the shaft 102 and having an opening 208 facing an underside of the plunger suction cup 104 within the concavity 204 for insertion of a portion of one or more disposable plunger bags 110. In FIG. 2, the hollow chamber is behind the opening 208 of the receptacle 202. In a further embodiment, one or more slots 206 are provided to frictionally retain a portion of one or more disposable plunger bags 110 within the receptacle 202. In a further particular embodiment, a plurality of radially oriented slots 206 are provided that frictionally retain a portion of one or more disposable bags 110 within the receptacle 202.

The purpose of the receptacle 202 is to retain a disposable bag 110 in position while covering the suction cup 104. For instance, a disposable bag 110 can be opened, a hand inserted into the opened disposable bag 110, and a finger can push a small portion of the disposable bag 110 into the receptacle 202. Upon removal of the finger from the receptacle 202, the disposable bag 110 can be retained therein via friction provided from the slots 206. The disposable bag 110 can then be pulled over the suction cup 104 to completely seal the suction cup 104 from contamination that may occur during use of the plunger device, such as to unclog a toilet or sink. The disposable bag 110 can be held in place over the suction cup 104 by hand or can be retained by another retaining element such as a hook, clasp, or receptacle on the shaft 102 or the handle 112.

In view of the foregoing, the receptacle 202 can be differently located. For instance, the receptacle 202 can be offset to one side within the concavity 204. Alternatively, the receptacle 202 can be on an outside surface of the suction cup 104. Furthermore, the receptacle 202 can be positioned on the shaft 102. There may also be multiple receptacles 202 such as the one illustrated and another receptacle 202 such as one on the shaft 102 to retain a disposable bag 110 in multiple places.

The slots 206 can be one, two, three, four, or more in number. The flaps surrounding the slots 206 can be semi-flexible, yet rigid enough to maintain shape and retain a disposable bag 110 in place until unneeded.

The receptacle 202 can be substituted with a hook or clasp. For instance, the receptacle 202 can be a hook and a disposable bag 110 can include a tab for sliding over the hook. Alternatively, the receptacle 202 can be a clasp that removably secures a portion of a disposable bag therein until released.

It is further possible to omit the receptacle 202 altogether. In such embodiments, a disposable bag 110 is placed over the receptacle and held in place by hand during usage of the plunger device 100.

Figure 3:
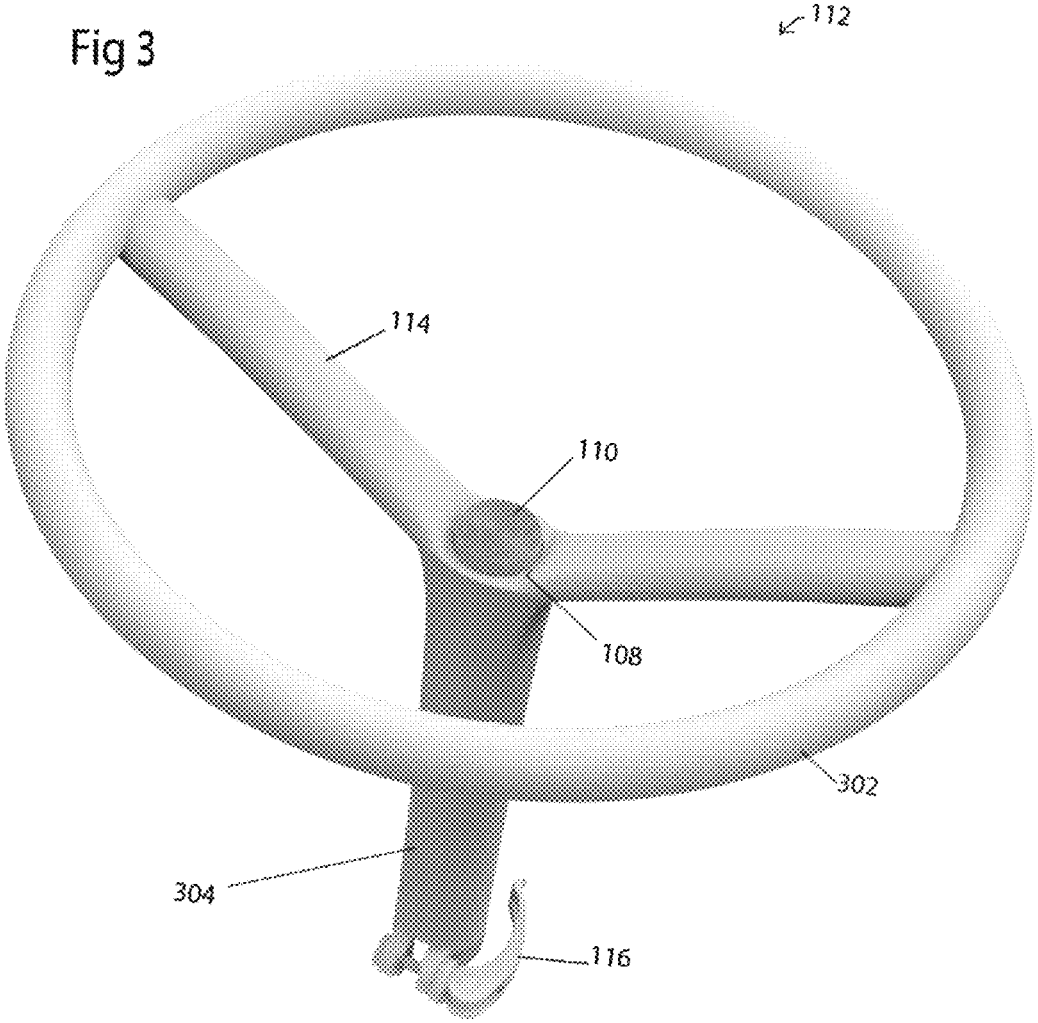
FIG. 3 is a top perspective view of a plunger device handle, in accordance with an embodiment of the invention.

FIG. 3 is a top perspective view of a plunger device handle, in accordance with an embodiment of the invention.

In one embodiment, a handle 112 is removable and attachable to a plunger device. The handle 112 includes a circular member 302 having one or more radial arms 114 that extend at least partially horizontally from the handle shaft 304, the circular member 302 circumscribing the handle shaft 304 about a substantially constant radius. In certain embodiments, the circular member 302 comprises two radial arms 114 that extend upwardly and outwardly from an end of the handle shaft 304. The handle 112 includes a hollow chamber 108 disposed within the handle shaft 304 for storing one or more disposable plunger bags 110.

The circular member 302 can be oval, square, rectangular, a horizontal bar, a horizontal bar with vertical handles, a butterfly handle, or other handle shapes as illustrated and described in the provisional applications incorporated by reference.

The radial arms 114 can be one, two, three, or more radial arms or may be omitted in favor of a disk shape or other structural supporting member. The radial arms 114 extend horizontally and lightly vertically out from the handle shaft 304 to the circular member 302. However, the radial arms 114 can alternatively extend less vertically, such as directly horizontal/perpendicular to the handle shaft 304. Moreover, the radial arms 114 can extend downwardly from an end of the handle shaft 304. The radial arms 114 are depicted as extending from an end of the handle shaft 304, but the radial arms 114 can alternatively extend from a point before an end of the handle shaft 304.

The hollow chamber 108 is positioned at an end of the handle shaft 304 to permit storage and access to a roll of disposable bags 110. The hollow chamber 108 is approximately ½ inches to 3 inches in diameter. However, the hollow chamber 108 can be located in a different position on the handle 112. For example, hollow chamber 108 can be positioned on a side surface of the handle shaft 304, such as near the clasp 116. Alternatively, the hollow chamber can be incorporated into the circular member 302 or the radial arms 114. It is also possible to omit the hollow chamber 108 altogether.

The handle 112 is therefore removably attachable to an existing plunger handle by sliding the handle shaft 304 over a tip of an existing plunger handle and engaging the clasp 116. Once secured to an existing plunger handle, the handle 112 provides enhanced leverage and ergonomics and further provides storage and access to the disposable bags 110.

Figure 4:
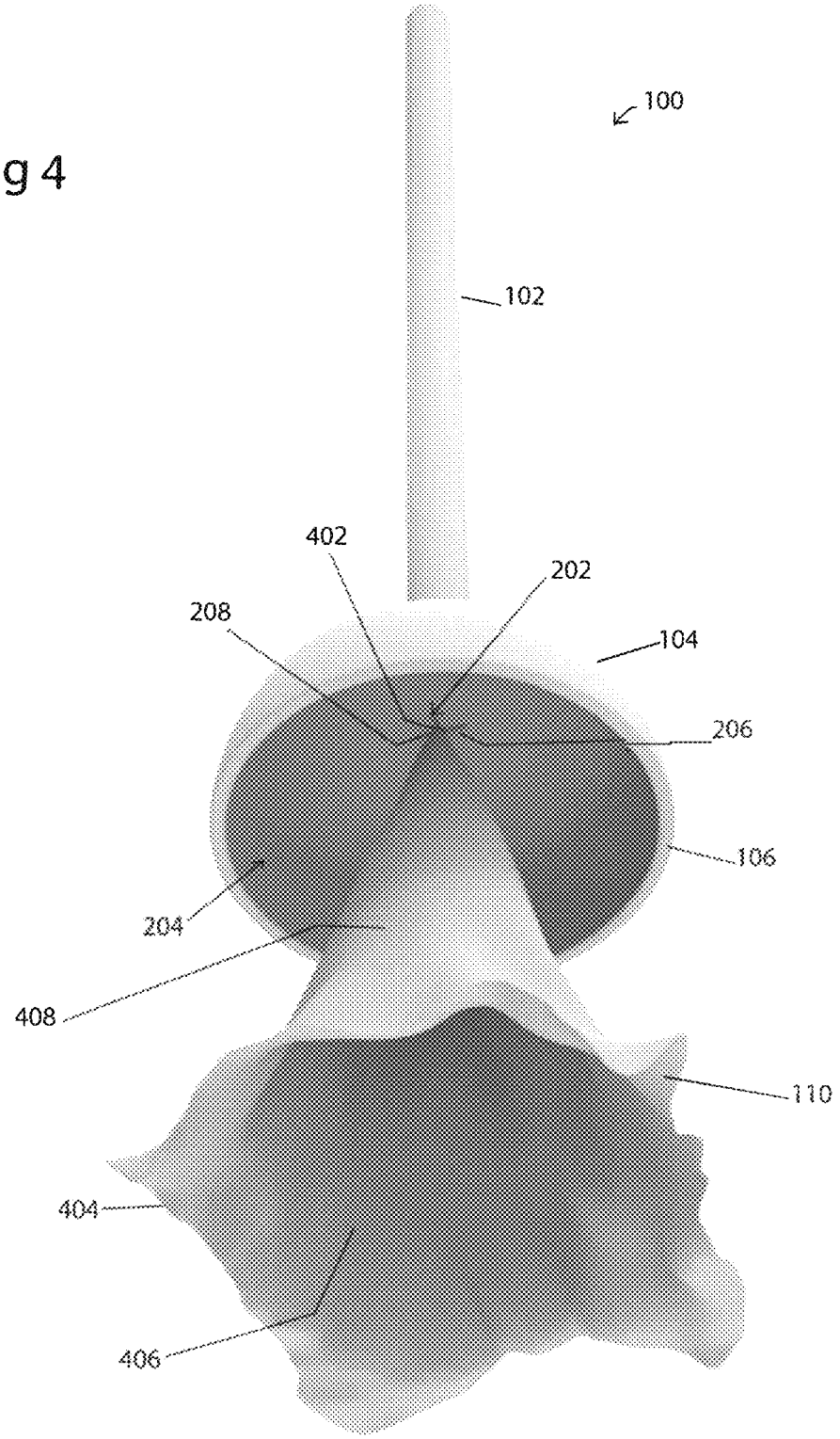
FIG. 4 is a bottom perspective view of a plunger device cup, in accordance with an embodiment of the invention.

FIG. 4 is a bottom perspective view of a plunger device cup, in accordance with an embodiment of the invention. In one embodiment, a plunger device 100 includes, but is not limited to, a shaft 102; a plunger suction cup 104 coupled to the shaft 102, which plunger suction cup 104 flares from the shaft 102 to a perimeter edge 106 to define a concavity 204; and a receptacle 202 centrally positioned within the concavity 204 on an underside of the plunger suction cup 104 for removably retaining one or more disposable plunger bags 110.

In certain embodiments, the receptacle 202 includes, but is not limited to, a hollow chamber in line with a longitudinal axis of the shaft 102 and having an opening 208 facing an underside of the plunger suction cup 104. The receptacle 202 can include a cover 402 over a hollow chamber, which cover includes the opening 208 for insertion of a portion of the one or more disposable plunger bags 110. One or more slots may be provided to frictionally retain a portion of the one or more disposable plunger bags 110. The one or more slots 206 can be radially oriented as depicted.

In other embodiments, the shaft 102 includes an elongated member that extends from the plunger suction cup 104 and that stores the one or more disposable plunger bags 110.

In one particular embodiment, the one or more disposable bags 110 are biodegradable and/or flushable plunger bags.

In certain embodiments, the disposable bag 110 can be pushed into the receptacle 202 using a finger or other pointed object such that the slots 206 pinch the disposable bag 110 at least partially therein. Typically, the center of the disposable bag 110 is jammed or inserted into the receptacle 202 as depicted such that the remainder of the disposable bag 110 flows therefrom. An edge 404 of the disposable bag 110 can thereafter be pulled over the suction cup 104 such that the inside surface 406 is exposed and the outside surface 408 faces the suction cup 104. The edge 404 of the disposable bag 110 can be gripped by hand or secured to a bullous tab, hook, or clasp associated with the shaft 102. Thus, the plunger device 100 can be used to unclog or clear a pipe, toilet, drain, or channel whilst the disposable bag 110 insulates the suction cup 104 and the shaft 102 from contamination. The receptacle 202 keeps the disposable bag 110 close to the suction cup 104 during usage of the suction cup 104. Thereafter, the disposable bag 110 can be removed by pulling or otherwise disconnecting it from the suction cup 104 (e.g., allowing the water from a flush to pull it off). In the case of a toilet, the disposable plunger bag can be dropped into the toilet and flushed therethrough. The plunger device 100 can be returned to its stowed location without requiring cleaning or sanitization.

The disposable bag 110 can be approximately 5 to 18 inches by 5 to 18 inches or can define a volume of approximately ½ gallon to 3 gallons. The disposable bag can include one or more handles proximate the edge 404 (e.g., holes or extensions) that can facilitate grip during usage of the disposable bag 110. The disposable bag 110 can be non-disposable (e.g., reusable and washable) or disposable. The disposable bag 110 can further be compostable, biodegradable, recyclable, or non-biodegradable or non-compostable. In the case of being compostable or degradable, the disposable bag 110 dissolves or begins to breakdown when exposed to water or other liquid after approximately 1-5 minutes to allow for structural integrity during operation of the plunger device 100. In the case of being biodegradable, the disposable bag 110 may be flushable by dissolving or breaking down when exposed to water or other liquid after approximately 2-5 minutes to allow for structural integrity during operation of the plunger device 100.

The disposable bag 110 can be stored within the receptacle 202 and pulled therefrom for usage. Multiple bags can be stored within the receptacle and separable along a perforation. Alternatively, the one or more disposable bags 110 can be stored within the shaft 102, such as rolled around the shaft 102 or disposed within a concavity or bin within the shaft 102. Likewise, the disposable bag 110 can be stored within a pouch or pocket of the suction cup 104.

The shaft 102 or the receptacle 202 can include a guide or clasp or hook to secure the disposable bag 110 in position during usage. Alternatively, the disposable bag 110 can be gripped by hand around the shaft 102 while the plunger device 100 is in operation.

It is contemplated that the disposable bag 110 can be non-secured within the receptacle 202 or the like. For instance, the disposable bag 110 can simply cover the suction cup 104 when the plunger is used. The plunger device 100 can further be used without a disposable bag 110, such as in the event of exhaustion of supply of any disposable bags 110.

Figure 5:
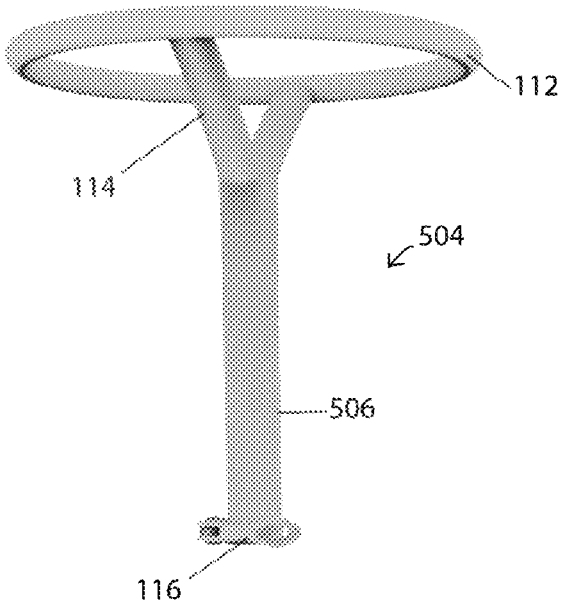
FIG. 5 is a perspective view of a plunger device with a removable handle, in accordance with an embodiment of the invention.
Figure 5:
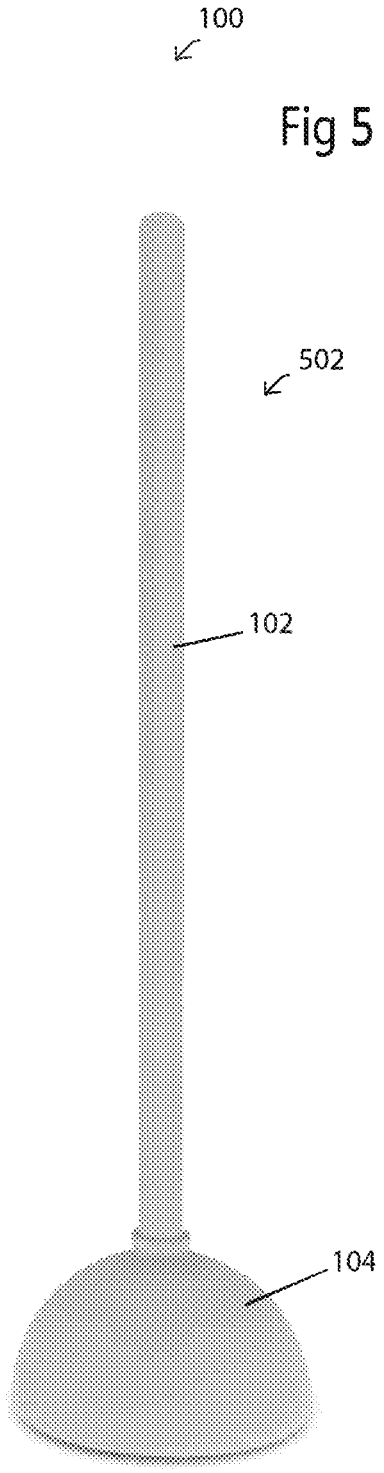

FIG. 5 is a perspective view of a plunger device with a removable handle, in accordance with an embodiment of the invention. In one embodiment, the plunger device 100 includes, but is not limited to a plunger 502 and a removable handle portion 504. The plunger 502 includes a shaft 102 and a suction cup 104. The removable handle portion 504 includes a handle 112 connected to a tubular portion 506 via one or more radial arms 114.

In certain embodiments, the plunger 502 can include any of the embodiments described or illustrated herein. Alternatively, the plunger 502 can be a common plunger that is typically acquirable via one or more retailers. The removable handle portion 504 can be removably attached to the plunger 502 by sliding the shaft 102 within the tubular portion 506. The clasp 116 can be engaged to cinch and/or secure the removable handle portion 504 to the shaft 102 and/or can be disengaged to release the removable handle portion 504 from the shaft 102. Thus, in some embodiments, the removable handle portion 504 can be used with existing common plunger devices to improve usability.

The handle 112 can assume any of the shapes or sizes described an illustrated herein, including the description and figures of all incorporated by reference provisional patent applications. The radial arms 114 likewise can be one, two, three, or more, or even can be eliminated or used as handles themselves. The tubular portion 506 can be approximately 3 inches to approximately two feet in length and can be approximately ½ inch to 3 inches in diameter. The tubular portion 506 can include a hollow bored internal area that spans a portion or substantially the entire length of the tubular portion 506 to permit insertion of the shaft 102. The tubular portion can include threads, gaskets, or other structure to assist in securing and maintaining the shaft 102 within the tubular portion 506. The claps 116 can be adjustable in tension and can be supplemented or replaced by many alternative securing mechanisms. For instance, threads of the tubular portion 506, a locking pin, a snap button, or the like can be used in lieu of or in addition to the clasp 116.

Figure 6:
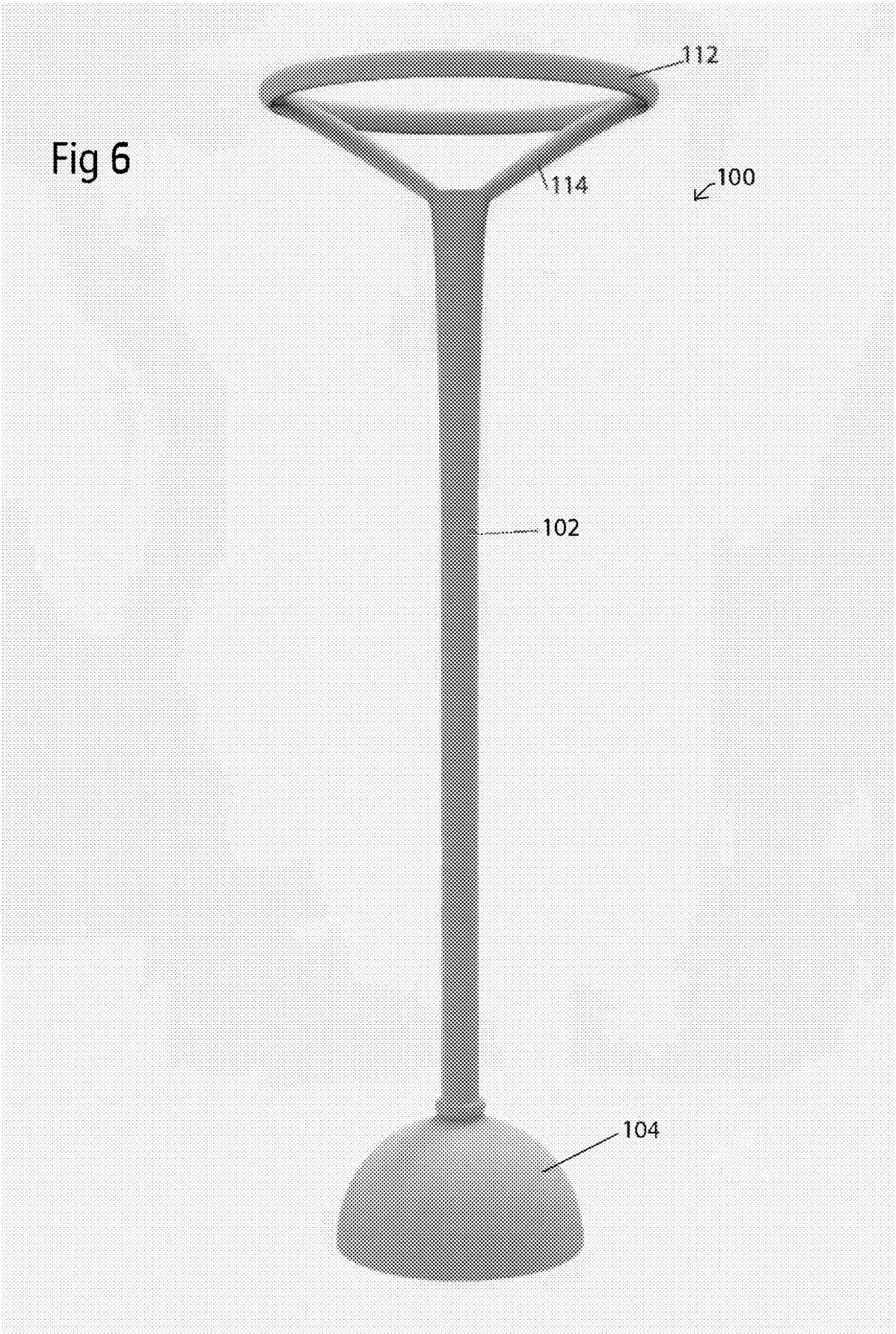
FIG. 6 is a perspective view of a plunger device, in accordance with an embodiment of the invention.

FIG. 6 is a perspective view of a plunger device, in accordance with an embodiment of the invention. In one embodiment, the plunger device 100 includes a handle 112 connected to the shaft 102 via one or more radial arms 114. A suction cup 104 is connected to the shaft 102 opposite the handle 112. This embodiment illustrates that the handle 112 can be integrated with the shaft 102. Other embodiments disclosed and illustrated herein may apply to the integrated handle 112/shaft 102 combo. For example, the handle 112 may include a storage compartment for one or more disposable bags to facilitate stowing and dispensing of the one or more disposable bags. Likewise, the suction cup 104 may include a retaining mechanism on its underside to facilitate retaining of a portion of the one or more bags during usage of the plunger device 100. For instance, the retaining mechanism may include a slotted opening, a flap, a hook, a clasp, or the like.

In certain embodiments, the plunger device 100 may be constructed of wood, metal, plastic, rubber, natural, or synthetic material. The plunger device 100 can include an overall height of approximately 2 feet to 5 feet. The handle 112 can include a diameter of approximately 6 inches to approximately 2 feet. The suction cup 104 can be approximately 3 inches to 1 foot in diameter. The suction cup 104 can be removable and the handle 112 can be similarly removable.

In other embodiments, the handle 112 can adopt any of the shapes described and illustrated herein or within any of the incorporated by reference provisional patent applications. For instance, the handle 112 can be a horizontal bar, a horizontal bar with vertical grips on opposing ends of the horizontal bar, a butterfly grip, or the like. The radial arms 114 can similarly be one, two, three, or more or can even be eliminated as described herein.

Figure 7:
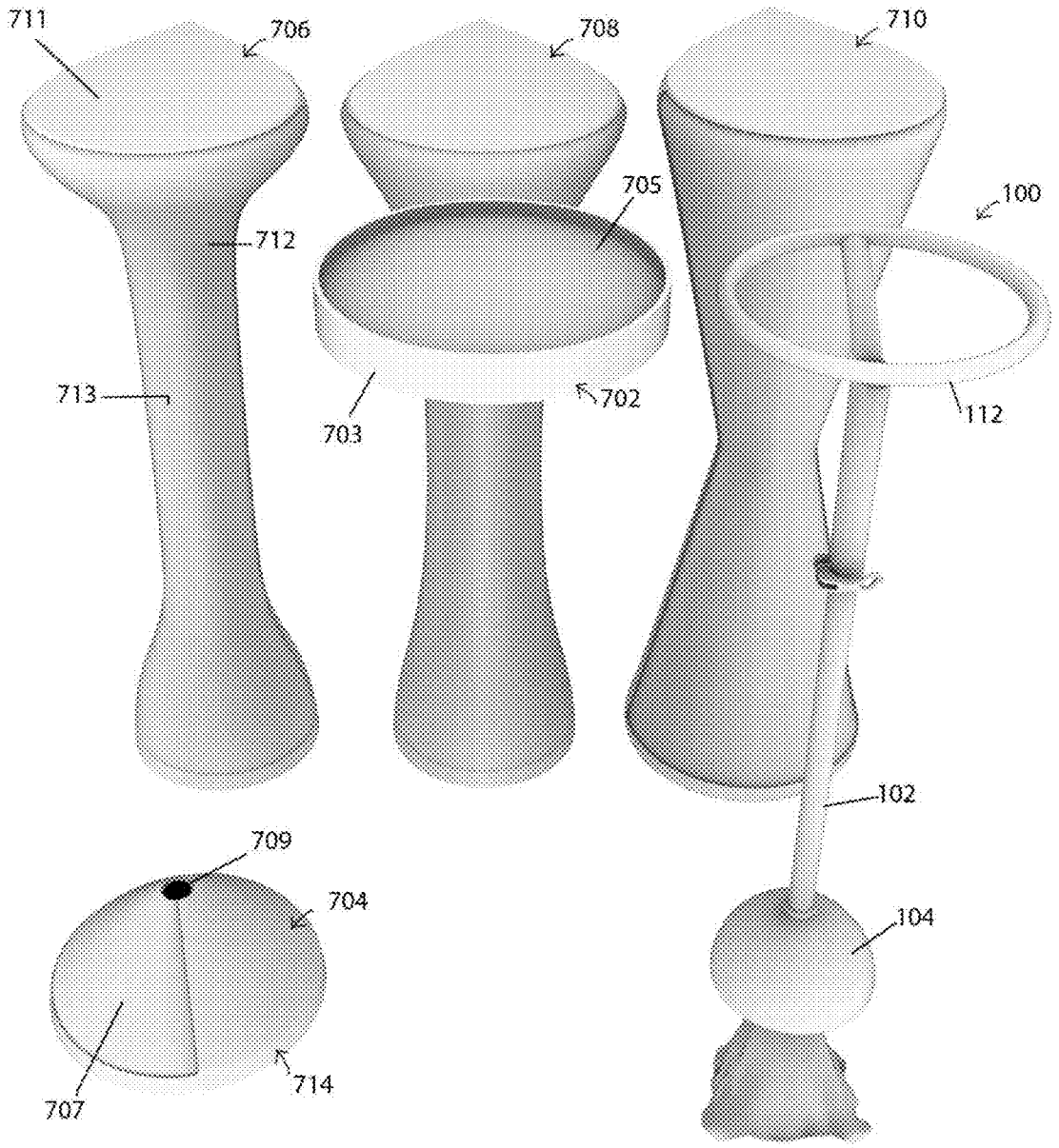
FIG. 7 is a perspective view of accessories for a plunger device, in accordance with an embodiment of the invention.

FIG. 7 is a perspective view of accessories for a plunger device, in accordance with an embodiment of the invention. In one embodiment, the accessories to the plunger device can include a removable cap 702 that attaches to or covers the handle 112 to provide a table surface for supporting objects and/or concealing the handle 112 when the plunger device 100 is between uses. In one particular embodiment, the removable cap 702 includes a perimeter flange 704 with open bottom that accommodates the circular member of the handle 112 and that includes a solid top 705 that provides a table surface for supporting objects or concealing the handle 112 when the plunger device 100 is between uses.

In another embodiment, the accessories to the plunger device 100 can include a base receptacle 704 that covers the plunger suction cup 104 when the plunger device 100 is between uses. In one particular embodiment, the base receptacle 704 includes a sidewall 707 that flares outwardly from a top aperture 709 to a bottom surface, which base receptacle 704 defines an enclosure for receiving the plunger suction cup 104. In another particular embodiment, the base receptacle 704 includes a slidable door 714 in the sidewall 707, which slidable door 714 is configured to open and close the base receptacle 704 for storing or retrieving the suction cup 104/the plunger device 100 therefrom. In one specific embodiment, the slidable door 714 includes a slidable panel.

In a further embodiment, the accessories to the plunger device 100 include an enclosure (e.g., 706, 708, or 710) that includes a slidable panel 712. The enclosure 706 may include a recessed waist 713 with a horizontal top surface 711 The enclosure 706 may be sized and shaped to store an entire plunger device 100 therewithin between uses, wherein the plunger device 100 is insertable and removable relative to the 3 enclosure 706 via the slidable panel 712.

The removable cap 702 can be differently sized or shaped. For example, the removable cap 702 can be square, triangular, rectangular, or other regular or irregular shape. The removable cap 702 can include one or more perimeter edges which can be ½ inch to 5 inches in height. The removable cap can be approximately 6 inches to 3 feet in diameter. The removable cap 702 can have multiple levels or shelves to permit storage or display of objects in a Z or height axis. Furthermore, additional storage or display surfaces may be provided along the shaft 102, such as one or two surfaces that are securable midway along the shaft.

The base receptacle 704 can be differently sized or shaped. For instance, the flared shape depicted may be substituted with a cylindrical, cubical, or other regular or irregular shape. The slidable door 714 may be omitted to reveal an opening for inserting or removing the suction cup 104. Alternatively, the slidable door 714 may include a flap or a door that opens about a hinge. Furthermore, the base receptacle 704 may extend partly or entirely upwards to conceal the shaft 102.

The enclosure 706 can assume a variety of shapes. For instance, the enclosure 706 can be cylindrical, triangular, square, or any other regular or irregular shape. The enclosure 706 can include storage shelves, drawers, or small cabinets built-in, such as to store toiletries or reading material. The horizontal surface 711 can include a circular, square, triangular, or other shape. One particular shape is depicted which includes a teardrop shape that permits the horizontal surface to be fitted within a corner, which is often present adjacent to a toilet.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A plunger device comprising:

a shaft with a circular handle attached to a first end of the shaft, the circular handle including:

one or more radial arms that projects away from the shaft;

a circular member that is affixed to the one or more radial arms and that includes one or more horizontal hand-grip areas;

a plunger suction cup coupled to the shaft at a second end of the shaft opposite the first end, which plunger suction cup flares from the shaft to a perimeter edge to define a concavity; and a receptacle centrally positioned within the concavity on an underside of the plunger suction cup for removably retaining one or more disposable plunger bags, the receptacle being contained entirely within the plunger suction cup.

2. The plunger device of claim 1, wherein the receptacle comprises:

a hollow chamber in line with a longitudinal axis of the shaft and having an opening facing an underside of the plunger suction cup.

3. The plunger device of claim 2, wherein the hollow chamber further comprises:

a cover over the hollow chamber, which cover includes at least one opening for insertion of a portion of one or more disposable plunger bags.

4. The plunger device of claim 3, wherein the at least one opening of the cover comprises:

one or more slots that frictionally retain a portion of one or more disposable plunger bags.

5. The plunger device of claim 3, wherein the at least one opening of the cover comprises:

a plurality of radially oriented slots that frictionally retain a portion of one or more disposable bags.

6. The plunger device of claim 1, wherein the shaft comprises:

an elongated member that extends from the plunger suction cup; and a hollow chamber disposed within the elongated member for storing one or more disposable plunger bags.

7. The plunger device of claim 6, wherein the hollow chamber is disposed within the elongated member at an a first end of the elongated member opposite the plunger suction cup.

8. The plunger device of claim 1, further comprising:

a handle that extends at least partially horizontally from the shaft—wherein the circular handle includes four radial arms.

9. The plunger device of claim 1, wherein the circular handle is removably attached to a first end of the shaft.

10. The plunger device of claim 1, further comprising:

a removable cap that attaches to an end of the shaft to provide a table surface for supporting objects when the plunger device is between uses.

11. The plunger device of claim 1, further comprising:

a removable cap that includes a perimeter flange with open bottom that accommodates the circular handle and that includes a solid top that provides a table surface for supporting objects when the plunger device is between uses.

12. The plunger device of claim 1, further comprising:

a base receptacle that covers the plunger suction cup when the plunger device is between uses.

13. The plunger device of claim 12, wherein the base receptacle includes a sidewall that flares outwardly from a top aperture to a bottom surface, which base receptacle defines an enclosure for receiving the plunger suction cup.

14. The plunger device of claim 13, wherein the base receptacle further comprises:

a slidable door in the sidewall, which slidable door is positioned within the track and configured to slide along the track to open and close the base receptacle for storing or retrieving the plunger device therefrom.

15. The plunger device of claim 1, further comprising:

an enclosure that includes a slidable panel, the unitary enclosure being sized and shaped to store an entirety of the plunger device between uses, the enclosure including a top flared portion and a bottom flared portion.

16. The plunger device of claim 15, wherein the top flared portion of the enclosure includes a horizontal surface for supporting objects thereon.

17. The plunger device of claim 1, further comprising:

one or more disposable biodegradable and flushable plunger bags that break down after 1-5 minutes after exposure to water or other liquid.

18. A plunger device comprising:

a shaft with a circular handle attached to one end, the circular handle including:

one or more radial arms each having a first end that is affixed to the shaft and a second end that projects away from the shaft;

a circular member that is affixed to the second end of the one or more radial arms and that includes one or more horizontal hand-grip areas;

a plunger suction cup coupled to the shaft at a second end of the shaft opposite the first end, which plunger suction cup flares from the shaft to a perimeter edge to define a concavity;

a clasp integrated into the shaft for retaining disposable plunger bags while in use; and a receptacle centrally positioned within the concavity on an underside of the plunger suction cup for removably retaining one or more disposable plunger bags, the receptacle being contained entirely within the plunger suction cup.

19. A plunger device comprising:

a shaft including a hollow chamber for storing one or more disposable plunger bags located at one end and a circular handle attached to the one end, the circular handle including:

one or more radial arms each having a first end that is affixed to the shaft and a second end that projects away from the shaft;

a circular member that is affixed to the second end of the one or more radial arms and that includes one or more horizontal hand-grip areas;

a plunger suction cup coupled to the shaft, which plunger suction cup flares from the shaft to a perimeter edge to define a concavity;

a receptacle centrally positioned within the concavity on an underside of the plunger suction cup for removably retaining one or more disposable plunger bags, the receptacle being contained entirely within the plunger suction cup;

a clasp integrated into the shaft for retaining disposable plunger bags while in use;

one or more disposable plunger bags that break down after 1-5 minutes after exposure to water or other liquid that are stored in the hollow chamber of the shaft; and a circular removable cap that includes a perimeter flange with open bottom that accommodates the circular handle therewithin and that includes a solid top that provides a table surface for supporting objects when the plunger device is between uses.

* * * * *